US007106880B2

(12) United States Patent
Bengtsson

(10) Patent No.: US 7,106,880 B2
(45) Date of Patent: Sep. 12, 2006

(54) UNIVERSAL RIBBON ELEMENT-MODULE FOR TWO OR MORE MEMBRANE-WIDTHS WITH OPTIMIZED FLOW AND DRIVE

(76) Inventor: Bo Philip Bengtsson, Bo Bengtsson, c/o Pat Glaser, Bäverns Gränd 18 B, 1tr., Uppsala, 753 19 (SE)

( * ) Notice: Subject to any disclaimer, the term of this patent is extended or adjusted under 35 U.S.C. 154(b) by 255 days.

(21) Appl. No.: 10/686,643

(22) Filed: Oct. 17, 2003

(65) Prior Publication Data

US 2004/0131222 A1 Jul. 8, 2004

Related U.S. Application Data

(62) Division of application No. 09/961,149, filed on Sep. 24, 2001, now abandoned.

(30) Foreign Application Priority Data

Sep. 26, 2000 (SE) ..... 0003491

(51) Int. Cl.
*H04R 25/00* (2006.01)

(52) U.S. Cl. ..... 381/398; 381/399; 381/176; 381/431; 381/116; 381/117

(58) Field of Classification Search ..... 381/176, 381/399, 396, 431, 414, 408, 116, 117, 111, 381/113, 59, 96

See application file for complete search history.

(56) References Cited

U.S. PATENT DOCUMENTS 4,085,299 A * 4/1978 Hobrough ..... 381/55
4,319,096 A 3/1982 Winey
5,721,784 A * 2/1998 Bernardo ..... 381/89

FOREIGN PATENT DOCUMENTS

SE 0003491-8 3/2002

* cited by examiner

*Primary Examiner*—Curtis Kuntz
*Assistant Examiner*—Tuan D. Nguyen

(57) ABSTRACT

A loudspeaker module in the form of a ribbon element, where the module can be equipped with a membrane, 50 millimeters in width or narrower, and with any length from 50 millimeters to 2500 millimeters. The magnet system is equipped with so called booster-magnets in order to reduce loss of magnetic flow in the soft iron pole pieces and in order to equalize and in order to even the magnetic flow at the magnet ends. The signal-feed is designed in the form of passive current-feeding, whereby the inductance's negative impact of the frequency response up to the 1/f point is eliminated. Above the 1/f point, the ribbon membrane is compensation fed from a separate circuit consisting of R and C, whose values have been chosen in such a way that the resulting frequency response is flat over the whole operating area.

2 Claims, 6 Drawing Sheets

Fig 3
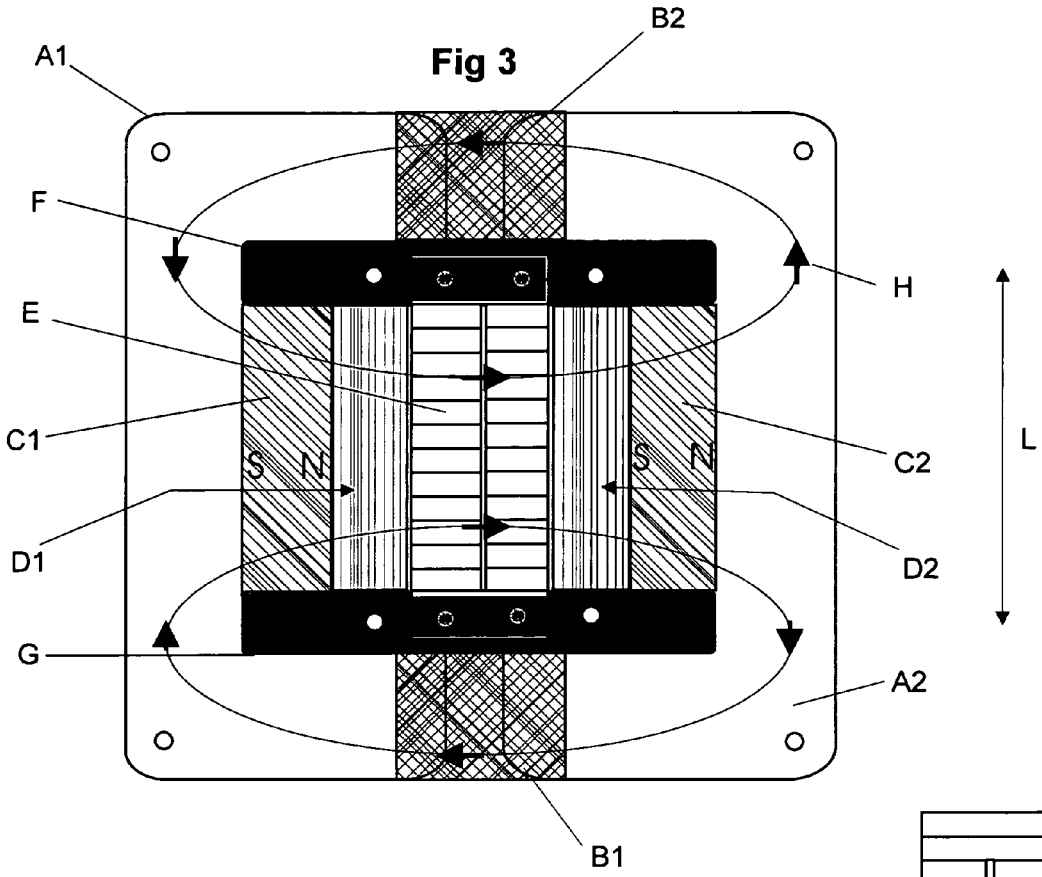
Fig 4
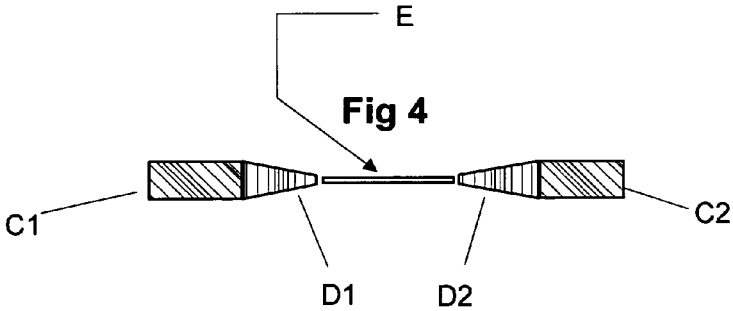
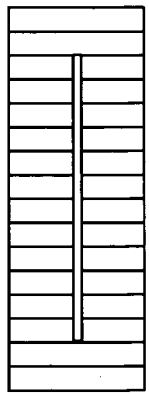
Fig 6
Fig 5
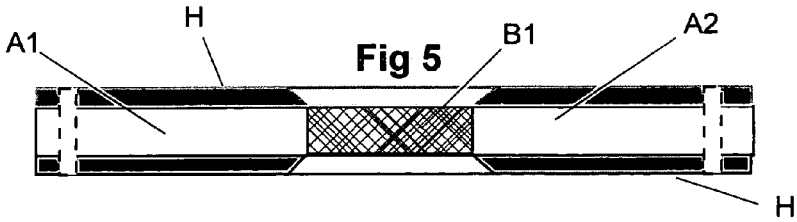

UNIVERSAL RIBBON ELEMENT-MODULE FOR TWO OR MORE MEMBRANE-WIDTHS WITH OPTIMIZED FLOW AND DRIVE

This is divisional from U.S. Ser. No. 09/961,149, now abandoned.

SUMMARY

The described invention refers to a new type of loudspeaker module in the form of a ribbon element, designed in such a way that the module can be optionally equipped with a membrane, 50 millimeters in width or narrower, and with any length from 50 millimeters to 2500 millimeters. In the case were the module shall utilize a more narrow ribbon, elongated field concentrating pole shoes are mounted between the magnets and the ribbon. In that way a higher efficiency is achieved and also the risk of edge reflection is reduced. It is furthermore advantageous if the module's soft iron pole pieces, contrary to established practice are mounted along the sides of the magnets in such a way that the membrane is allowed to radiate freely forwards as well as backwards.

It is preferred that the magnet system is equipped with so called booster-magnets in order to reduce loss of magnetic flow in the soft iron pole pieces and in order to equalize and in order to even the magnetic flow at the magnet ends. It is furthermore preferred that the signal-feed is designed in the form of passive current-feeding, whereby the inductance's negative impact of the frequency response up to the 1/f point is eliminated.

Above the 1/f point, the ribbon membrane is compensation fed from a separate circuit consisting of R and C, whose values have been chosen in such a way that the resulting frequency response in flat over the whole operating area.

BACKGROUND OF THE INVENTION

1. The Area of the Invention

The invention refers to advantageous constructions of ribbon-type loudspeakers.

2. Prior Art

The working principle of the ribbon speaker is well known. Inside a magnetic field, a ribbon made from an electrically conducting material is stretched, on both sides surrounded by powerful elongated permanent magnets. When an AC current within the audio band is applied to the ribbon, the membrane will start to oscillate in pace with the input signal.

The ribbon speaker technology suffers from two major problems: On one hand the linearity of the magnetic field is not homogenous; (typical solutions are glued ferrite magnets),—on the other hand the frequency response is not flat but decreasing with rising frequency, the last mentioned depending on the ribbon's mass/inertia and the inductance of the ribbon and the signal feeding cables. Last but not least, the width of the membrane has a serious impact on the ribbon amplitude. A wider ribbon results in a higher radiation resistance, i.e. a better coupling to the air, which means lower membrane amplitude which is essential if low frequencies with a satisfactory sound pressure level are to be reproduced.

Electrical Limitations:

The low electrical resistance of the ribbon speaker and its physical extension in space result in an inductance that seriously affects the frequency response and, most important, create serious phase errors. The preferred invention solves this problem by utilizing passive current feeding over the whole operating area below 1/f and also by a separate passive compensation feeding for the frequency range above the 1/f point.

The physical mass of the ribbon together with the strength of the magnetic field determines where the critical 1/f point occurs. This point is defined as the point where the ribbon goes from velocity-controlled to mass-controlled condition. Above this point, the ribbon output no longer is linear but decreasing with increasing frequency.

Mechanical Limitations:

The physical mass of the ribbon, combined with the strength of the magnetic field, determine, as earlier stated, where the critical 1/f point occurs. This point is defined as the point where the ribbon goes from velocity-controlled to mass-controlled condition. Above this point, the ribbon output no longer is linear but decreasing with increasing frequency.

THE PURPOSE OF THE INVENTION AND SUMMARY OF THE INVENTION

A basic purpose with the invention is (outgoing from the above described well known technical limitations) to accomplish an optimizing which makes possible high sound pressure levels with low distortion within the whole working interval. The described invention also aims to solve above related problematic conditions by the utilization of advanced modularization in order to realize a product with high performance which also is attractive from the manufacturing and cost point of view.

The described invention regards a ribbon type full frequency loudspeaker system where a modularization of the technology makes it possible to use one and the same chassis for at least two or more different membrane widths, preferably 25 and 50 millimeters respectively, with optimizing of the magnetic flow for the respective working conditions and where said ribbons are driven by using passive current feeding in order to overcome inductance related problems and where an optional number of modules can be combined in order to enable high sound pressure levels with low distortion within the whole operating interval.

The invention also regards a particular, preferred module, suitable for use and especially so in a modularized utilization of a loudspeaker system This invention thus refers to a new type of loudspeaker module, in the form of a ribbon element, designed in such a way that the module, free of choice, can be equipped with a membrane 50 millimeters in width or narrower, and with a length free of choice within 50 millimeters to 2500 millimeters. In those cases where the module shall be utilized with a narrow ribbon, the magnet field concentrating pole pieces are mounted between the magnets and the ribbon. This results in a higher efficiency at the same time as it reduces the risk for edge reflection. It is also preferable if the soft iron pole pieces [(A1)/(A2) in FIG. 3 and FIG. 7] contrary to common praxis are mounted sideways from the magnets in such a way that the membrane is allowed to radiate freely, without any obstructions as well forwards as backwards.

It is furthermore preferred that the magnet system is equipped with so called booster magnets in order to reduce magnetic flow losses in the pole pieces and in order to equalize the flow at the finalizing ends of the magnet system. It is furthermore preferred that the signal feeding is designed as a passive current feeding, whereby the negative impact on the frequency response up to the 1/f point is eliminated. Above the 1/f point the ribbon is compensation fed from a special circuit, consisting of R and C whose values have been chosen in such a way that the resulting frequency response curve gets flat over the entire operating area.

SHORT DESCRIPTION OF FIGURES

FIGS. 1A–E shows the frequency response for a ribbon type loudspeaker for different examples mentioned in the continued description.

FIG. 3 shows a front view of a ribbon module with magnets, pole pieces and a ribbon membrane.

FIG. 4 shows a cross section view of a ribbon placed in between magnets and pole pieces.

FIG. 5 shows another cross sectional view of the same ribbon module with booster magnets.

FIG. 6 shows a preferred embodiment of a ribbon with a slit in the middle.

DETAILED DESCRIPTION OF POSSIBLE APPLICATIONS OF THE INVENTION HERE DESCRIBED

Figures 1A, 1B, 1C, 1D, 1E:
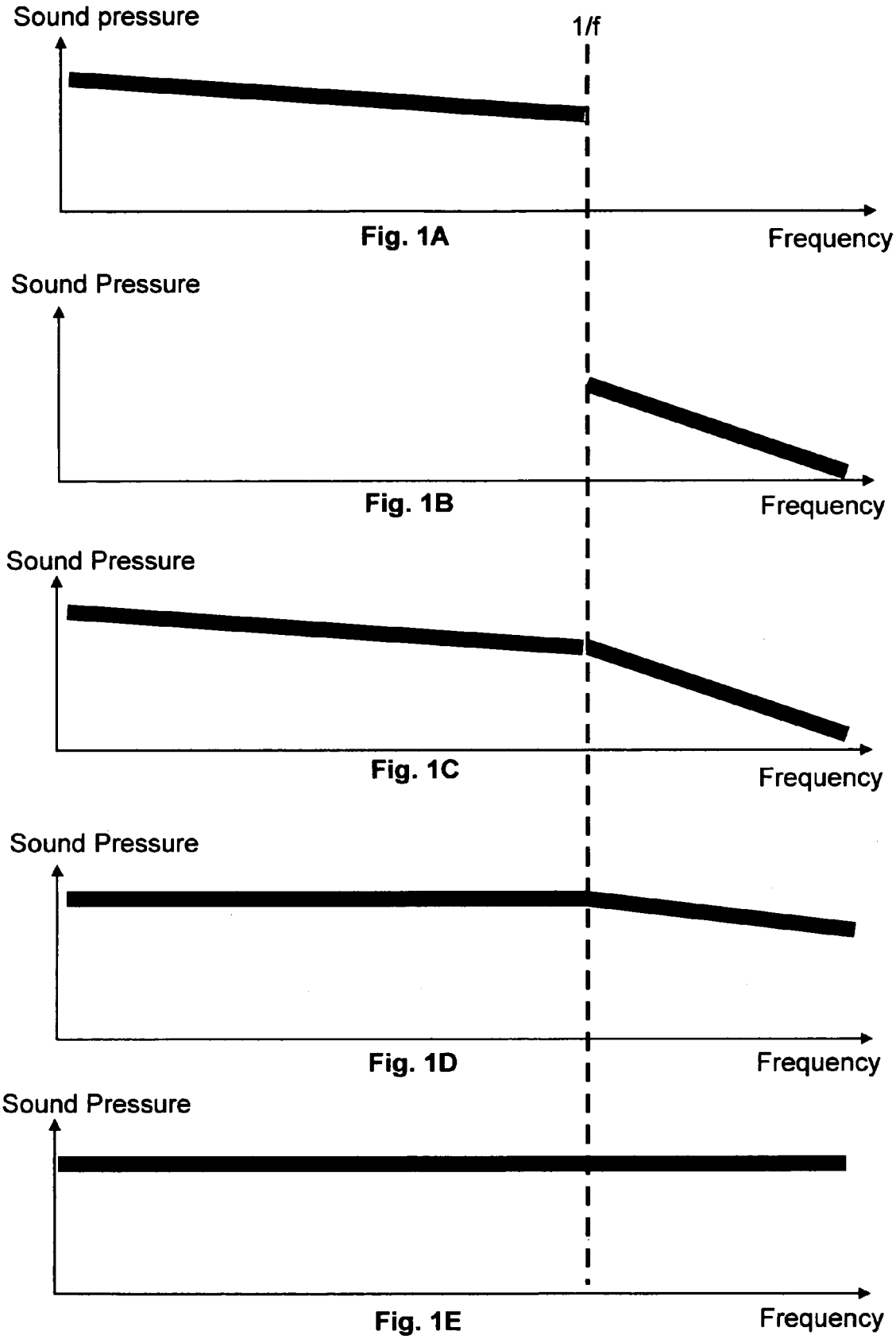

FIG. 1A shows a typical frequency response for an uncompensated ribbon element from 100 Hz and up to the 1/f point. FIG. 1B shows the frequency response under same conditions above the 1/f point FIG. 1C shows the resulting frequency response for the whole operating interval.

By connecting a power resistor with extremely low self-inductance according to FIG. 2 (B) in series with the ribbon, a controlled voltage drop (depending on the value of the resistor in relation to the ribbon resistance) is achieved, resulting in that the ribbon will be current fed. This type of feeding eliminates the problemacy with the inductance in the ribbon itself. The resulting frequency response for the frequency range up to the 1/f point is shown in FIG. 1D.

Figure 2A:
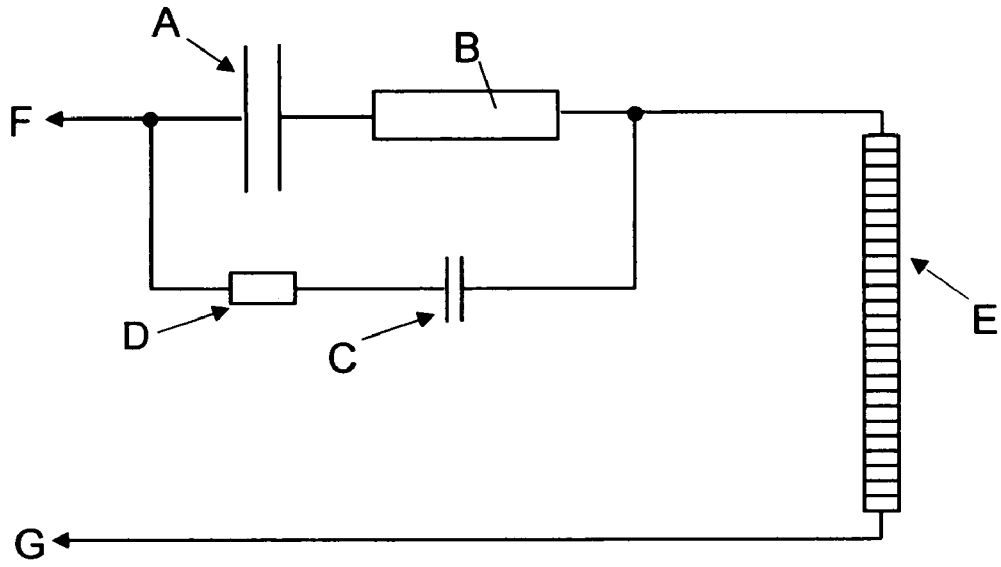
FIG. 2A shows a circuit wiring diagram for power feeding of a ribbon membrane.

FIG. 2A (among other things) shows a capacitor (A) serving as a first order crossover network, 6 dB/octave.

In FIG. 2A the shunt capacitor (C) has a value that compensates for the decreasing output above the 1/f point. FIG. 2A (D) is a low inductance resistor with a value of about 1/10 till 1/100 of the value of (B) in FIG. 2A. The resulting frequency response is shown in FIG. 1E.

The component values for R and C in FIG. 2A is depending of the resistance value of the ribbon (E) and the desired crossover frequency, the latter being determined by the capacitor (A) and the resistor (B) in relation to the resistance value of the membrane (E).

In FIG. 2A, (F) and (G) constitute the connecting points to the circuit. (F) and (G) might, where it is applicable, be connected directly to a commercial power amplifier, capable of driving low impedance loads. As an alternative, the points (F) and (G) might be connected to the secondary side of a full transformer in order to comply with the CE norms regarding electrical security.

Figure 2B:
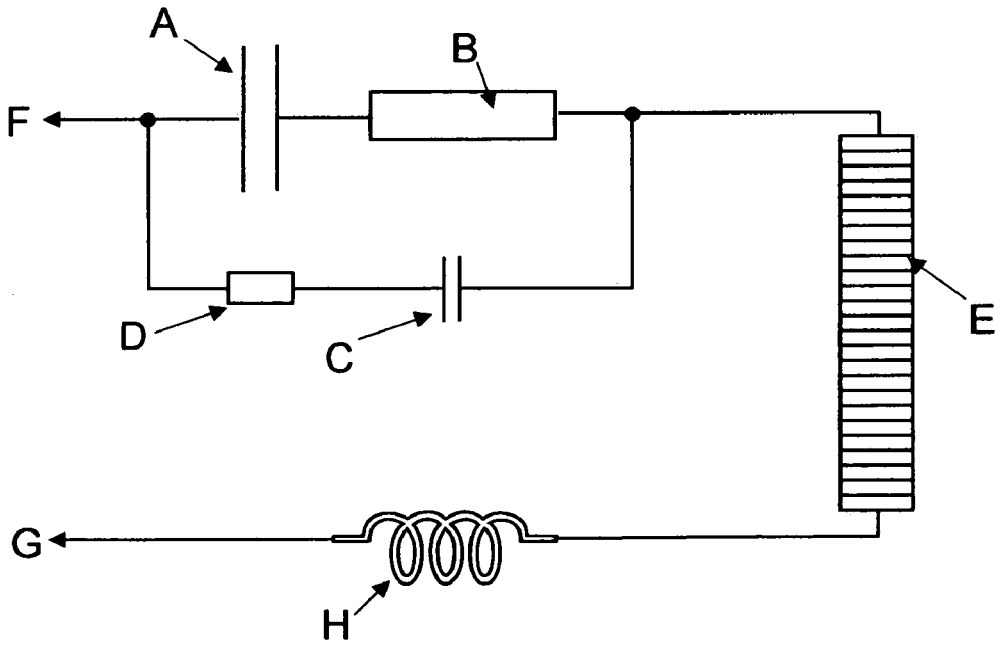
FIG. 2B shows an improved version of a circuit-wiring diagram for such a power feeding.

FIG. 2B shows the same wiring diagram and functionality as FIG. 2A with the exception of the coil (H) which provides for a 6 dB/octave cutoff with rising frequency. This solution is utilized in those circumstances where it is preferred to use the 50 mm wide ribbon in the module chassis in order to reproduce frequencies below 1 kHz. The coil (H) in this case acts as a first order low pass filter.

By increasing the magnetic flow in the gap and simultaneously reducing the moving mass in the membrane, the 1/f point can be moved upwards in frequency (but not be completely eliminated). This method also increases the sensitivity of the system, so that a lower electrical input power in necessary for a given sound pressure.

Figure 11:
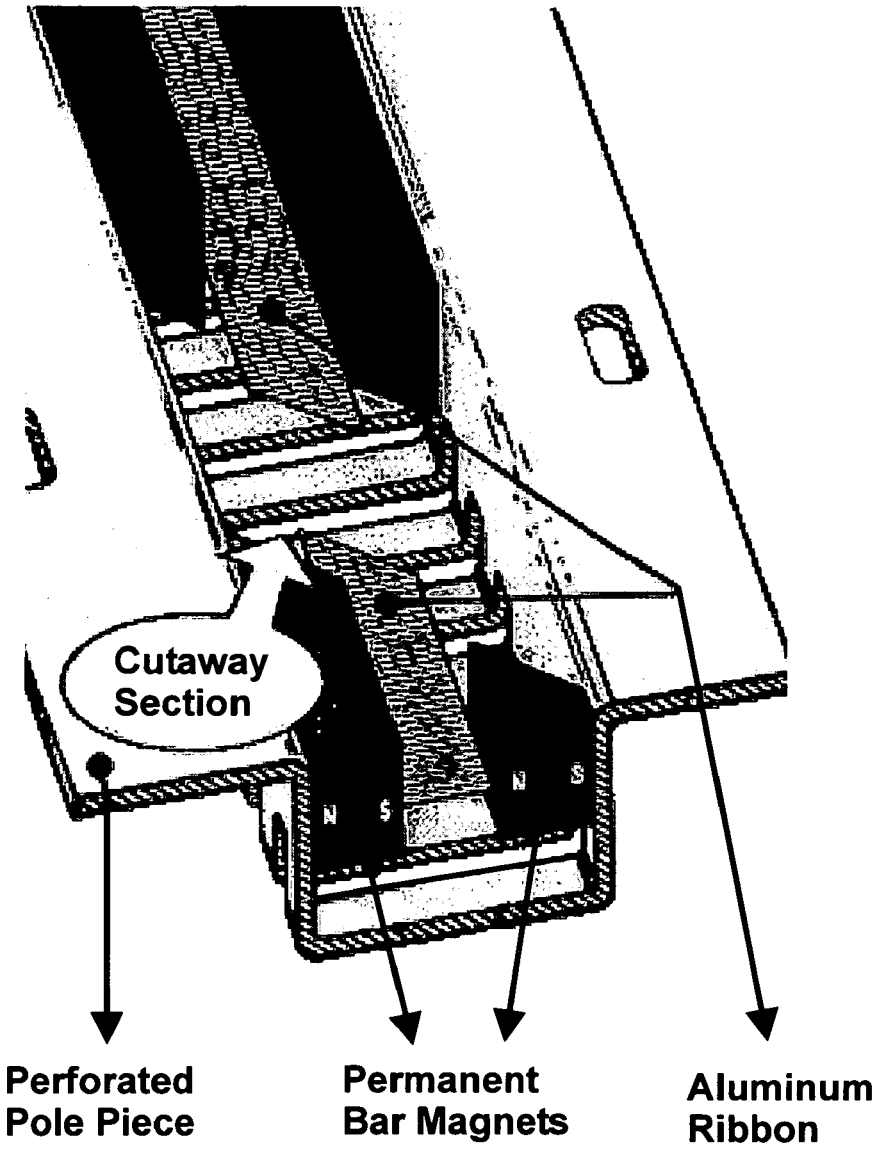
PRIOR ART Fig 11
FIG. 11 shows an example of prior art where the return of the magnetic field is located behind the sound emitting ribbon.

From practical points of view, there is a limit for how thin the ribbon membrane can be made with reasonable demands for mechanical strength and the capability to handle input power. This problem earlier has been dealt with by implementing U-shaped pole pieces behind the magnet system, in order to achieve a closed magnetic flow. This method results in heavy and mechanically complicated systems, which also increase depth, thereby occupying more room space. To place the pole pieces behind the magnets furthermore influences the sound quality in a negative way as it makes it harder to obtain a true dipole system, i.e. as a system that radiates equally forwards and backwards. With pole pieces located behind the ribbon membrane, a lot of the backward radiated energy will reflect back and color the sound. FIG. 11 illustrates this. Said Fig emanates from an American patent application (MAGNEPAN Inc.) and clearly shows that the space between the slits in the pole piece will reflect back a considerable amount of energy and thus induce coloration and resonances.

The present invention is directed to this problem and proposes applying the pole pieces along the magnet's sides instead of behind them, in such a way that the membrane is allowed to freely radiate backwards as well as forwards.

FIG. 3, FIG. 4 and FIG. 5 show how this has been solved in the preferred embodiments of the invention. FIG. 3 (A1) and (A2) and FIG. 5 (A1) and (A2) show the physical orientation of the soft iron pole pieces in the plane relative to the main magnets, the latter shown in FIG. 3 (C1) and (C2), plus FIG. 4 (C1) and (C2). FIG. 3 shows a front view of the pole pieces and FIG. 5 (A1) plus (A2) show the pole pieces with the module laid down.

FIG. 4(E) shows the membrane orientation in relation to the magnet system (C1)/(C2) and in relation to the magnetic flow concentrating soft iron pole pieces D1/D2 the latter being utilized when a module is going to be used together with the narrow ribbon for reproduction of frequencies above 1 kHz. The design of the latter pole pieces is made in such a way that edge reflection is avoided.

FIG. 3(H) shows the direction of the magnetic field. FIG. 5(H) shows the outer protecting non-magnetic plates, with their beveled slit-shaped sound opening.

FIG. 3(G) and (F) shows the isolators on which the membrane rests. These isolators have 4 holes in them in order to be able to be used with an optional ribbon.

In order to be able to compensate for loss of flow in the pole pieces, so called "booster magnets" have been implemented. Their design and placement can be seen in FIG. 3 (B1) and (B2) and FIG. 5, showing the booster-magnet (B1) from the under side. The resulting flow is as mention earlier shown in FIG. 3(H).

By designing the magnet system this way, a system with extremely short depth is achieved at the same time as the sound energy from the ribbon membrane is allowed to radiate freely forwards as well as backwards. The cooperation between the booster-magnets, the main magnets and the soft-iron pole pieces makes it possible to obtain a magnetic flow in the gap with very high linearity, allowing for construction of a ribbon element with a long linear membrane amplitude, in practice equaling the physical depth of the magnets, according to FIG. 8 that shows membrane/magnet-orientation in those cases where the broad band for low frequency reproduction is utilized. If the magnetic air gap according to FIG. 3 has a preferentially a width of 50 millimeters and the pole pieces (D1)/(D2), shown in FIG. 3 and FIG. 4 each has a width of 12 millimeters, the module will be optimized for a ribbon membrane 25 millimeters in width, resulting in a horizontal sound dispersion of 170 degrees. The length (height) can be chosen freely within the interval of 50 millimeters to 2500 millimeters. FIG. 4 and FIG. 5 thus show a version of what the module will look like when intended for high frequency reproduction within 1 kHz to 40 kHz, equipped with a membrane of pure metal, preferably aluminum, without any plastic film as a base.

Also, the 25 millimeter ribbon membrane has a slit in the middle, (FIG. 6) in order to furthermore reduce non-linear magnetic forces which otherwise could result in a break of the membrane along its center line. This is important when short modules are used. FIG. 5(H) shows the module laid down, indicating the protective back and front plates, made from non-magnetic material. Their task is to keep together the construction mechanically. The beveling of the edges in the magnetic air gap in the protective back- and front plates prevents from cavity related sound distortion.

Figure 7:
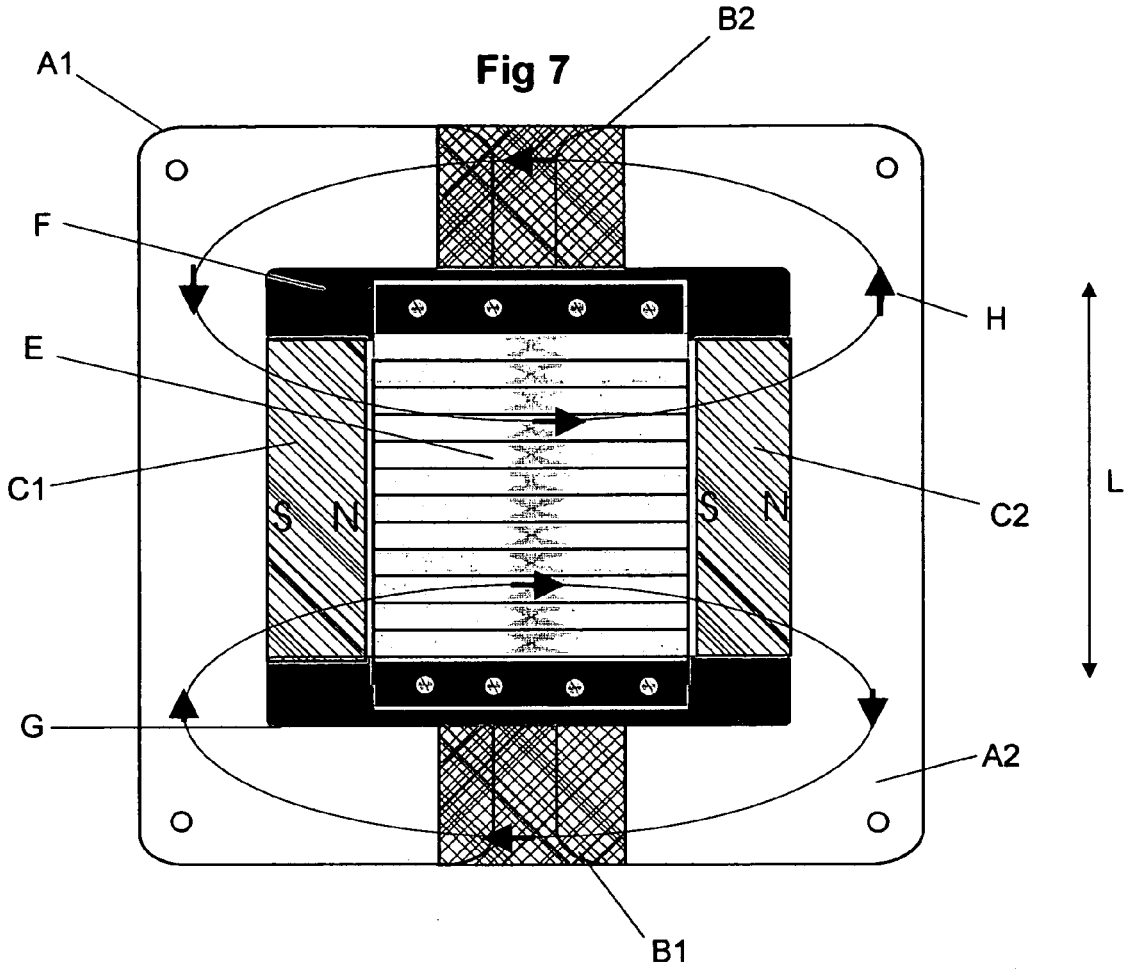
FIGS. 7, 8 and 9 shows figures from another preferred embodiment, corresponding to FIGS. 3, 4 and 5.
Figure 8:
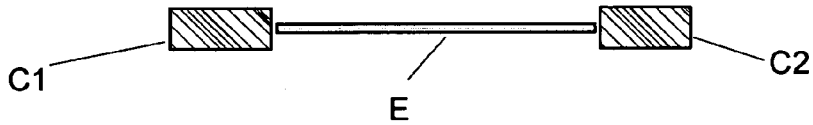
Figure 9:
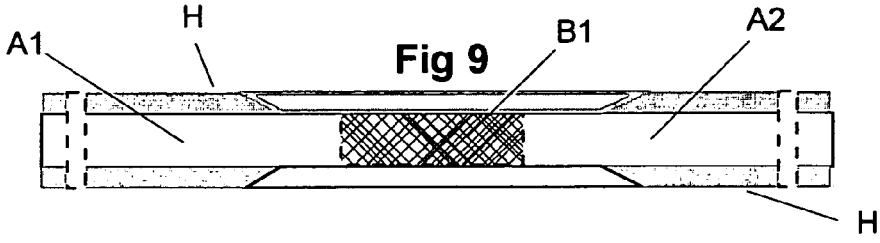

If the pole pieces (D1)/(D2) in FIG. 3 are removed, a singular ribbon membrane with twice the width, intended for reproduction of low frequencies can be mounted, see FIG. 7, FIG. 8 and FIG. 9.

Removal of the conical, field focusing pole pieces (D1)/(D2) means that the linear membrane amplitude is doubled. What is lost in magnetic force in this case, is to a large degree compensated for by doubling of the radiating surface of the ribbon. The efficiency is for all practical purposes basically the same. FIG. 4 and FIG. 8 show the difference in the layout of the magnetic gap in respective cases. By deliberately limiting the upper frequency response of the wide ribbon, the same sound dispersion as for the high frequency version is achieved.

Figure 10:
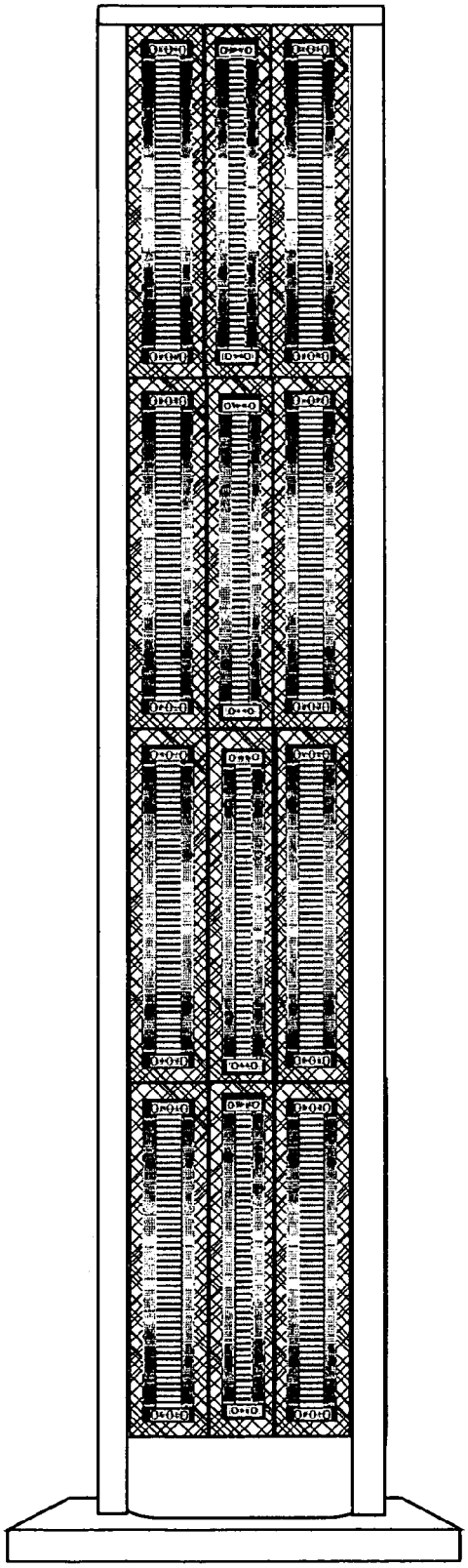
FIG. 10 shows a combination of ribbon modules which makes it possible to cover the whole frequency range between 20 Hz and 40.000 Hz.

Ribbon speakers have so far, due to their limitations, only been able to be used for those intervals within the audio band we call midrange and treble, i.e. the area from 1 kHz to 20 kHz. New magnet material plus the application of the ribbon technology as a line source makes it possible to realize constructions, spanning over the entire audio band from 20 Hz to 40 kHz,—see FIG. 10 showing an example of how a 2 meter high, full frequency ribbon-type loudspeaker according to the line-source concept might be utilized according to this invention. The extension downwards in frequency and thereby related sound pressure is determined by the number of low frequency modules. The more modules, the higher the radiation resistance, the higher the available sound pressure level.

Addendum

Experience has shown that the plate at which the magnets C1, C2, and the pole pieces D, D2 etc. are mounted, should be made from a non-electric conductive material. Attempts to make it from aluminum have turned out to give a sound with lower quality due to eddy currents, generated by the current through the ribbon.

Regarding the connections with RC-filters in FIGS. 2A and 2B, designed for high frequencies and low frequencies respectively, an elucidation should be made; The resistor B in FIG. 2A must have sufficient resistance relative to the impedance of the ribbon E, in order to achieve something which from the ribbon's side stands out as a current source, i.e. the current being substantially independent of variations in the impedance of the ribbon E. The resistor B in FIG. 2B should comply with the same demands in this respect. On the other hand, the capacitance of capacitor A in FIG. 2A is dimensioned to limit low frequencies from a crossover point, for example 5 kHz, whilst the capacitor A in FIG. 2B is dimensioned to give a limitation downwards, for example at 250 Hz. The purpose of the inductor H in FIG. 2B is to limit the input to the ribbon membrane E to frequencies below the crossover point, for example 5 kHz.

The purpose of the parallel-coupled RC filters D+C in FIG. 2A and FIG. 2B is to increase the input at higher frequencies and to compensate for the mechanical properties such as ribbon membrane thickness etc.

The concept is primarily to let the low frequencies be taken care of by wider ribbons than the high frequencies, due to the different efficiencies, however it is in many cases suitable to utilize the same width of the ribbon as well for low as high frequencies. It is also possible to divide the frequency range into more than two parts by adding further crossover networks.

With the above mentioned connections and magnet gap constructions it has been shown that the ribbon speakers of this invention are useful also with very long ribbons, and excellent functionality has been proven using 50-millimeter wide ribbons with a free length of 500 millimeters. FIG. 10 actually shows a loudspeaker where the wide ribbons have those dimensions. In this case, any booster-magnets according to FIG. 3 or 7 are out of the question.

The invention can be utilized in many different ways, and the purpose is that it shall not be limited by anything than the patent claim below.

What is claimed is:

1. A loudspeaker system comprising a plurality of ribbon loudspeaker element modules, some having narrow ribbon bands for reproducing higher frequencies and some having wide ribbon bands for reproducing lower frequencies, each such element being fed through a filter circuit having two parallel branches, each branch comprising a capacitor and a resistor in series, the capacitor of a first of said branches having the largest capacity being in series with a low inductivity high power resistor, and the capacitor in the second of said branches having a lower capacity than that of the first of said branches being in series with a resistor having a lower resistance than that of the resistor of said first branch, said low inductance high power resistors in said filter circuits of the filter modules being mounted in such a way that the modules act as heat sinks, said low inductance high power resistors having resistance values making said ribbon bands of the modules to be current-fed, eliminating problems with inductive influence causing a fall-off in sound pressure above a frequency depending on a ribbon's mass/inertia and the inductance thereof.

2. The loudspeaker system according to claim 1, wherein said ribbon loudspeaker element has an elongated, uniform-width, corrugated and electrically conductive, essentially non-ferromagnetic ribbon, at both ends electrically connected in an isolated manner, free to oscillate in an elongated opening in a substantially plane frame, the ends of said ribbon having means for connection to an electric sound signal source, an elongated permanent magnetic gap in the frame forming an elongated slot, said magnetic gap showing different magnetic polarities opposite to and adjacent to the ribbon membrane's both side edges, and magnetic means in the frame for creating a magnetic return circuit, said means located outside of and liberating said opening, said ribbon at least as to that part falling within said opening having a slit arranged in the middle of the ribbon, said slit being directed along the longitudinal direction of the ribbon.

* * * * *